US007618299B2

(12) United States Patent
Ferretti

(10) Patent No.: US 7,618,299 B2
(45) Date of Patent: Nov. 17, 2009

(54) EASY OFF LOW VOLTAGE MOUNTING

(75) Inventor: Michael Ferretti, Wind Gap, PA (US)

(73) Assignee: Thomas & Betts International, Inc., Wilmington, DE (US)

( * ) Notice: Subject to any disclaimer, the term of this patent is extended or adjusted under 35 U.S.C. 154(b) by 0 days.

(21) Appl. No.: 11/492,463

(22) Filed: Jul. 25, 2006

(65) Prior Publication Data

US 2007/0026745 A1 Feb. 1, 2007

Related U.S. Application Data

(60) Provisional application No. 60/703,778, filed on Jul. 29, 2005.

(51) Int. Cl.
*H01R 4/36* (2006.01)

(52) U.S. Cl. ..... 439/814; 439/798

(58) Field of Classification Search ..... 439/814, 439/798, 921, 797

See application file for complete search history.

(56) References Cited

U.S. PATENT DOCUMENTS

| | | | | |
|---|---|---|---|---|
| D309,664 | S | 7/1990 | McGrane | |
| D346,150 | S | 4/1994 | Triantopoulos | |
| D377,782 | S | 2/1997 | Fillinger | |
| 5,690,516 | A | 11/1997 | Fillinger | |
| 5,848,913 | A | 12/1998 | Ashcraft | |
| 5,931,708 | A | 8/1999 | Annas et al. | |
| 6,579,131 | B1 * | 6/2003 | Ashcraft et al. | 439/798 |
| 6,939,183 | B2 * | 9/2005 | Ferretti et al. | 439/798 |
| 7,014,514 | B2 * | 3/2006 | Zahnen | 439/798 |
| 2005/0233648 | A1 | 10/2005 | Siracki et al. | |
| 2005/0233649 | A1 | 10/2005 | Siracki et al. | |

FOREIGN PATENT DOCUMENTS

| | | |
|---|---|---|
| DE | 38 04 291 | 8/1989 |

* cited by examiner

*Primary Examiner*—Neil Abrams
*Assistant Examiner*—Phuong Nguyen
(74) *Attorney, Agent, or Firm*—Hoffmann & Baron, LLP

(57) ABSTRACT

A connector is attachable to an extending transformer stud. The connector includes a single hole or bore within the body of a connector to accept threaded transformer studs of different thread sizes. The connector can accommodate different size studs while still providing a compact design. The connector provides increased physical contact with the stud. The connector can be easily installed and removed from a stud without undue effort on the part of the installer. The stud connector includes an elongated passageway with three bore centers, wherein the thread center is slightly offset from the elongated passageway center and the elongated passageway having a diameter just slightly larger than the stud to be received. The elongated passageway includes more than one thread size milled or tapped into the bore circumference.

10 Claims, 5 Drawing Sheets

EASY OFF LOW VOLTAGE MOUNTING

CROSS-REFERENCE TO RELATED APPLICATION

This application claims priority to U.S. Provisional Patent Application No. 60/703,778, filed on Jul. 29, 2005, which is incorporated herein by reference.

FIELD OF THE INVENTION

The present invention relates generally to a connector for connecting to a transformer having a single stud hole with superimposed multiple threads. More particularly, the present invention relates to a transformer stud connector, having an easy-off stud mounting hole, for installing on studs of different sizes and which permits the connector to disengage the stud and slide off without the need for moving the connector from side to side.

BACKGROUND OF THE INVENTION

Electrical transformers are typically used to distribute electrical power from main utility lines for secondary distribution. The transformer accepts the main utility line on the primary side of the transformer and distributes the power from a secondary side of the transformer. An electrical step-down is provided by the transformer so as to provide for the proper secondary distribution of electrical power for residential and commercial use.

The transformer is normally housed in a steel cabinet. A threaded copper stud extends from the secondary side of the transformer from which secondary distribution is provided. Plural electrical conductors, connected to the threaded stud, provide for distribution of power to the end user.

In order to connect the conductor to the stud, a transformer stud connector is employed. These transformer stud connectors are elongate, electrically conductive members which are inserted over the copper stud extending from the secondary side of the transformer. The stud connector may be threadingly attached to the transformer stud. Extending longitudinally therefrom are a plurality of conductor accommodating ports wherein the ends of conductors may be inserted. Each conductor port has an associated set screw to effect mechanical and electrical connection to the transformer stud connector. Examples of transformer stud connectors are shown in U.S. Pat. Nos. 5,931,708; 5,848,913; 5,690,516; DES 377,782; DES 346,150; and DES 309,664.

In a typical arrangement, the utility distribution transformer has threaded studs typically ⅝-11 or 1-14, oversized applications can have larger 1¼-12, 1½-12 threaded studs or possibly a custom size dictated by customer needs. A connector, sometimes referred to as a bus bar, is used to connect to the stud and provide ports for multiple wire connections. The connector is threaded with the same pitch tread but the threaded hole is equal or larger to the diameter of the transformer stud. This allows the connector to be slipped on to the stud, known as a slip fit connector, instead of being spun onto the treaded shaft. This allows the connector to be installed and removed without having to remove any of the conductors. An orthogonally mounted set screw is typically used to secure the connector to the studded shaft. However, slip fit connectors, due to the presence of threads around the inside of the stud hole can sometime be difficult to remove from the stud. In many cases, once the setscrews securing the connector are loosened, the connector must still be wiggled up and down or side to side to get the connector to slide off. This can make removal of the connector a difficult and time consuming process as well as damaging the connector and stud threads by repeated contact between the threads while trying to wiggle the connector off of the stud. This problem can be exacerbated when the connector is adapted to receive more than one size stud due to the close tolerances that are required for the stud connector hole when more than one size stud can be accommodated within the connector.

In prior art connectors, various means were provided so that a single connector could be used to service studs of various sizes. One way is to provide at least two threaded holes, one for each of the stud sizes serviced by the connector. However, the disadvantage of such design is that it requires at least two holes, and therefore needs to be larger than necessary. Also, because by design the stud hole has to meet a certain depth to accommodate the stud, the portion of the connector receiving the threaded stud in not usable for conductor connections, thus additionally requiring a longer connector to accommodate an equal number of conductors. This problem is exacerbated for connectors having multiple threaded holes. In addition, a multi hole connector does not address the problems of easy installation and removal.

A further prior art design utilizes a tear-drop design of two holes which overlap and therefore produce a large diameter threaded hole having an arc-section of a smaller hole at the bottom of the larger hole, which extends beyond the perimeter of the larger hole. The disadvantage of this design is that it requires pre-drilling a smaller hole, followed by drilling of the second larger hole, partially overlapping the smaller hole. Alternately, the larger hole can be bored first, followed by milling or broaching of the bottom arc section to create the "tear-drop". Both methods therefore require a two-step process, which adds complexity and expense to the manufacturing process.

A third alternative prior art design utilizes a slider system mounted to the connector which has grooved sides at various levels on the connector body. By moving the slider, in the grooves, various gap sizes between the slider and the connector body can be formed. However, this design requires a second element, the slider, to be added to the connector, which adds complexity and expense to the manufacturing process.

It is therefore desirable to provide a transformer stud connector, which can be mounted on studs of various sizes without the complexity, or cost of prior art designs, has a more compact design, provides greater physical contact between the connector and the stud and provides for easy installation and removal of the connector with out extra effort or steps on the part of the user.

SUMMARY OF THE INVENTION

The present invention provides a connector, which can be attached to transformer studs of various sizes with a single threaded hole.

The present invention uses a single hole or bore within the body of a connector to accept two or more threaded studs of different thread sizes. Furthermore, the present invention can accommodate one or more different size studs while still providing a connector that has a compact design, provides increased physical contact between the stud and connector, is easily manufactured and can be easily installed and removed from a stud without undue effort on the part of the installer. This is accomplished in the present invention by producing a stud connector having an elongated passageway with three bore centers, wherein the thread center is slightly offset from the elongated passageway diameter and the elongated passageway being just slightly larger than the stud to be received. Furthermore, the elongated passageway includes more than one thread size milled into the offset bore diameter.

To that end there is provided an electrically conductive transformer stud connector comprising, a body with an elongated passageway centered at a first point, for receiving a transformer stud having threads of a particular root distance, a first thread corresponding to the transformer stud threads of a particular size within the elongated passageway wherein the elongated passageway is centered at a second point that is vertically offset from the first point by a distance equal to the root distance.

The present invention further provides a method of making an electrically conductive transformer stud connector comprising forming a cylindrical elongated passageway within a connector body centered at a particular point for receiving a stud of a predetermined root distance, forming a first threaded region corresponding to a predetermined thread size and pitch centered at a point that is vertically offset from the particular point, forming a second threaded region overlapping the first threaded region corresponding to a second predetermined thread size and pitch wherein the first threaded region and the second threaded region overlap along a single line of tangency.

As shown by way of a preferred embodiment herein, the connector of the present invention includes a single elongated passageway with an offset bore cradle for accommodating more than one thread size which is easy to install and remove.

DETAILED DESCRIPTION OF THE PREFERRED EMBODIMENT

Figure 1:
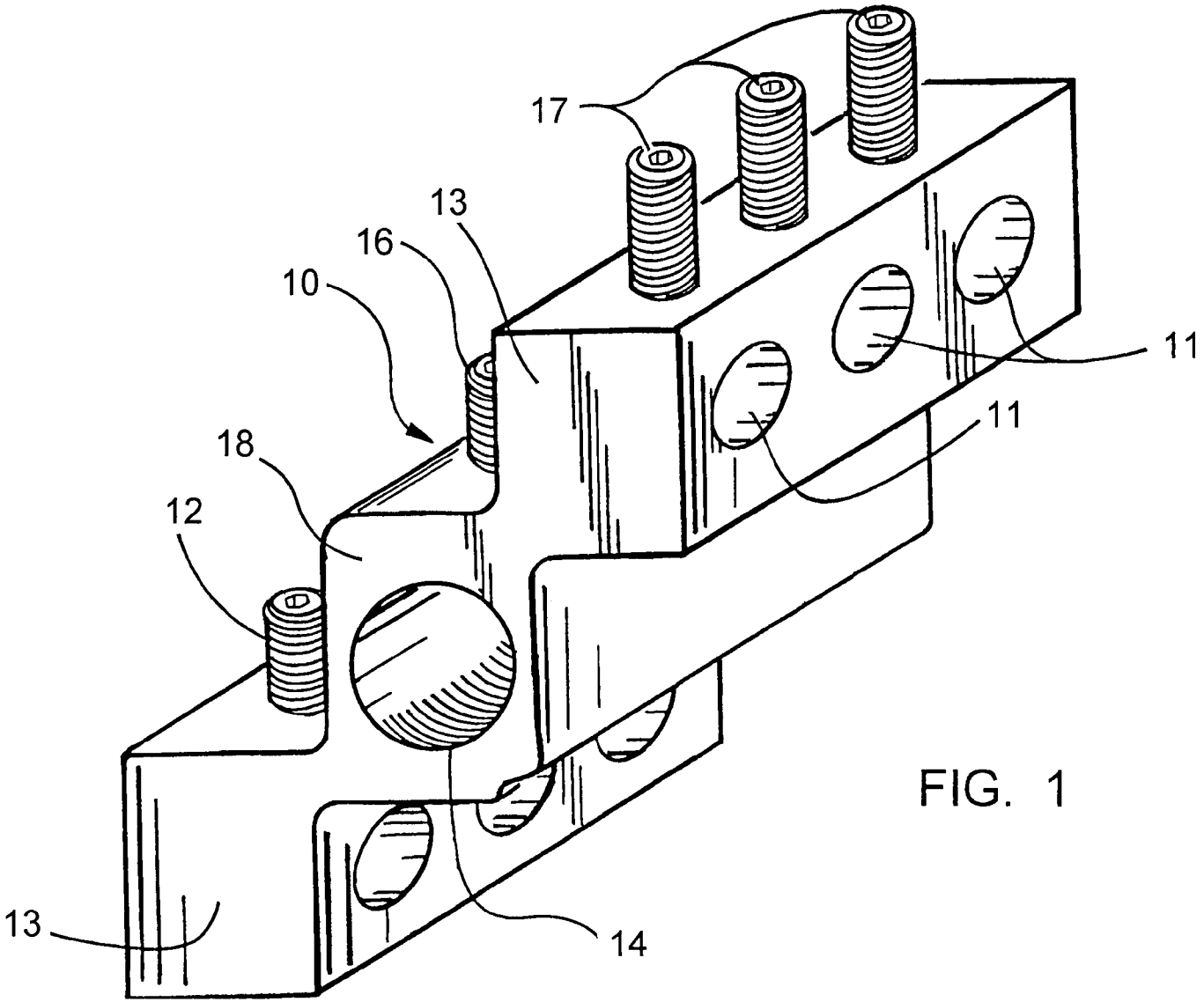
FIG. 1 is a perspective view of a portion of the connector according to the present invention.

Referring to FIG. 1, there is shown a perspective view of the connector according to the present invention. Shown is connector body 10 having a longitudinal bore 12 including threads 14 disposed along the inner diameter. Set screws 16 protrude from the top of connector body 10 and can be screwed into connector body 10 to contact transformer stud (not shown). As shown in FIG. 1, and which will be further described with respect to FIG. 2, threads 14 are helically disposed about a portion of the circumference of longitudinal bore 12. In a preferred embodiment, the threads 14 are helically disposed around up to approximately 130° of longitudinal bore 12, but threads 14 may also be disposed in a parallel or non-helical arrangement. There is further shown side surface 18 of the connector body 10, which, when mounted to a transformer stud faces the transformer.

The connector body 10 is an integrally formed metallic member, preferably formed of aluminum or other material, having high electrical conductivity. Transformer stud connector body 10 includes central, generally elongate cylindrical bore 12. The central bore 12 is internally threaded to accommodate the extending, externally threaded transformer stud (not shown). The length of bore 12 need only be approximately the length of the extending portion of the stud so that when the body is placed over the stud, the stud and the bore extend generally the same distance.

Transformer stud connector body 10 will typically include conductor-accommodating ports 11 for receiving conductors located on the cantilevered step portions 13 of connector body 10. In this way, additional conductor accommodating ports 11 can be added without extending the length of connector body 10.

Each conductor port will also include a securement device such as a set screw 17 for securing the conductor. Each set screw aperture is in communication with the respective conductor receiving port so that set screws 17 may be inserted therein to mechanically and electrically secure the ends of the conductors within the stud connector body 10. In a typical arrangement, each of the ports extends from one side surface of the connector body 10. The conductor ports are generally positioned on similarly facing surfaces so that conductors inserted into the ports can be inserted from the same direction.

Figure 2:
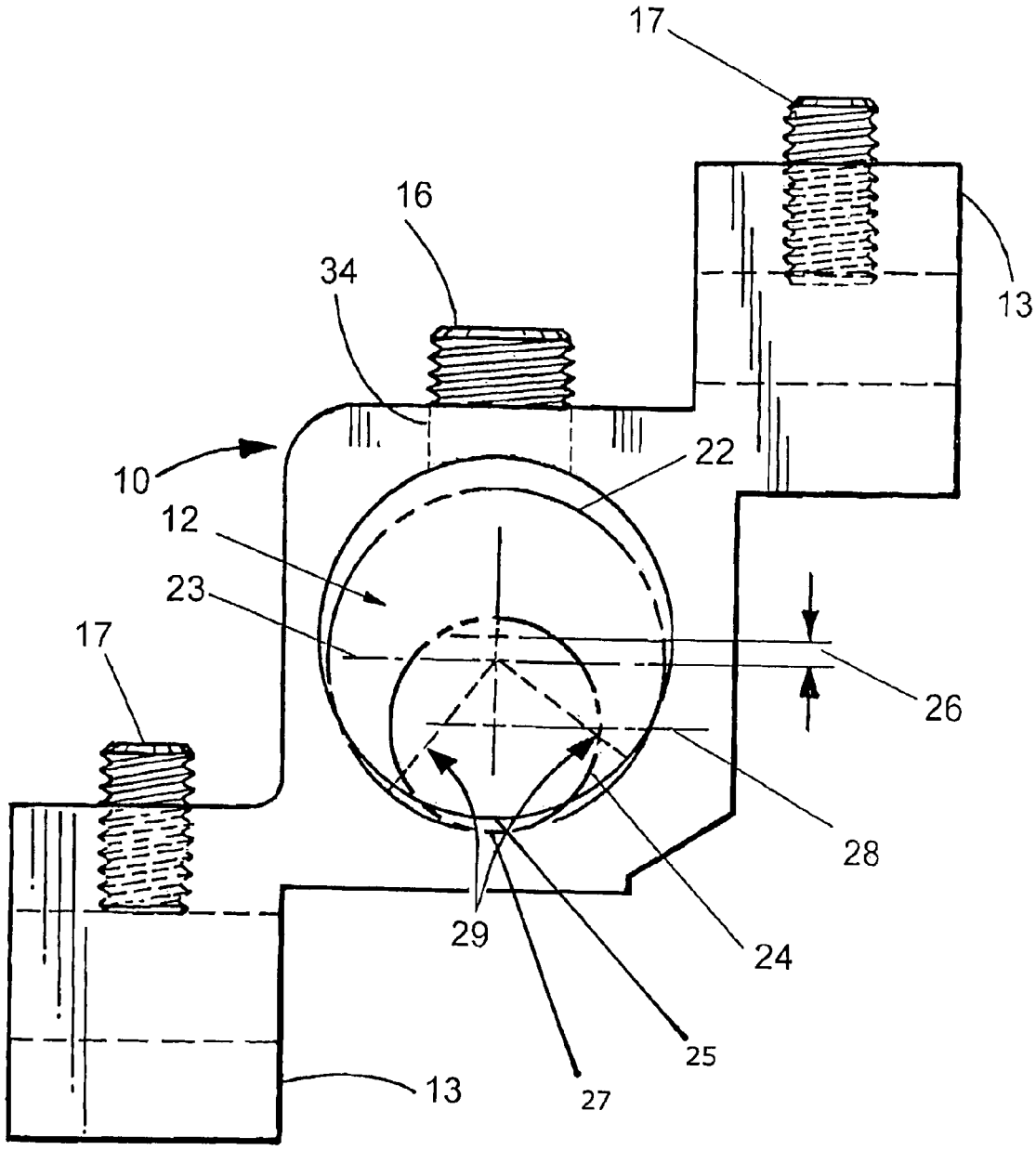
FIG. 2 is a cross-sectional drawing of a connector according to the present invention.

Referring now to FIG. 2, the transformer stud connector body 10 is depicted as having a central region with a longitudinal bore 12, and two cantilevered step portions 13. The longitudinal bore 12 includes an aperture 20 for receiving at least one particular size stud. In the particular example described with respect to FIG. 2, the longitudinal bore 12 is drilled to accept at maximum, a 1 inch stud. In the case of a 1-inch diameter stud, the aperture 20 is drilled to a diameter of 1.060 inches.

In accordance with the present invention, to accommodate the stud, once aperture 20 is drilled, the threads for a particular size thread are tapped into aperture 20. In the exemplary embodiment of the present invention described, two threads, a larger diameter thread 22 having a center point 23 and a smaller diameter thread 24, are tapped into aperture 20. The location of the larger diameter thread 22 is located with respect to the aperture center 21. The larger diameter thread 22 center 23 is offset from the aperture center 21 by a distance 26 that corresponds to the root distance between the valley and crest of the stud thread that is received into the larger diameter thread 22. The third center 28 of the smaller diameter thread 24 is located such that the smaller thread crest is tangent to the larger diameter thread crest at a point 25 along the base of aperture 20. By offsetting the center 23 of larger diameter thread 22 a cradle 27 is formed at the base of aperture 20.

By offsetting the tapped threads from the center 21 of aperture 20, the majority of the inside circumference of aperture 20 remains smooth, i.e., without threads. Therefore, it is easier to slip connector 10 onto the transformer stud since there is a smaller area of the inner circumference that is covered by threads that may catch onto the threads of the stud during installation or removal of the connector 10. In addition, aperture 20 can be drilled to a smaller dimension. In the example described, the aperture is only 0.060" larger than the stud size to be accommodated whereas it normally would be oversized at least ⅛" and typically ¼". Further, the size of the larger diameter thread 22 is the same size as the stud to be accommodated, it is not oversized. Due to the large diameter thread 22 being the same size as the stud diameter and the center 23 of the large diameter thread 22 being only slightly offset from the aperture center 21, the arc 29 for the larger diameter thread 22 spans up to about 130° of the aperture 20 inner circumference depending on thread profile. Therefore, because the radius of the large diameter thread 22 matches the stud diameter the contact surface in cradle 27 between the connector threads 14 and the stud is maximized, resulting in enhanced electrical conductivity.

Turning again to FIG. 2, connector 10 includes a set screw 16 for securing the connector to the threaded stud. The set screw 16 is received into the connector body in a threaded bore 34 and can thus be raised or lowered by rotating the set screw 16. In this way, the set screw 16 can be adjusted to contact a threaded stud within longitudinal bore 12.

In a preferred embodiment of the present invention, the connector 10 is produced by forming the longitudinal bore 12 by drilling into the connector body 10 to create a void or aperture 20. Thereafter, a first tap or milling operation is performed to form the larger diameter thread 22, which in the preferred embodiment may be a 1-14 thread. Once the large diameter thread 22 is formed, a milling operation is performed to form the small diameter thread 24, which in the preferred embodiment may be ⅝-11 thread. As will be further shown and described with respect to FIG. 5, the threaded regions are positioned within the connector body 10 by offsetting the large diameter thread center 23 from the aperture center 21 by a distance equal to the root distance between the valley and crest of the larger thread size chosen. The third center 28 of the smaller diameter thread 24 is located such that the smaller diameter thread crest is tangent to the larger thread crest at a point 25 along the base of aperture 20, which is typically directly opposite the set screw 16. In a three dimensional frame of reference with respect to the two threads 22 and 24, multiple points 25 would extend along a tangent line within cradle 27.

Removal of the overlapping thread sections could be done by a milling/threading/tapping operation on the side of aperture 20 where interlocking of the second stud in desired, typically opposite the set screw 16. Alternately, the overlapping thread sections can be formed at other locations around the entire inner diameter of longitudinal bore 12.

While the preferred embodiment of the connector according to the present invention is described with respect to a particular large and small thread pitch. It would be clear to one skilled in the art that any standard or non-standard thread pitches could be overlapped in the manner described. Likewise the present invention need not be limited to overlapping two particular thread pitches, but may include more than two particular thread pitches that are formed within aperture 20.

Figure 3:
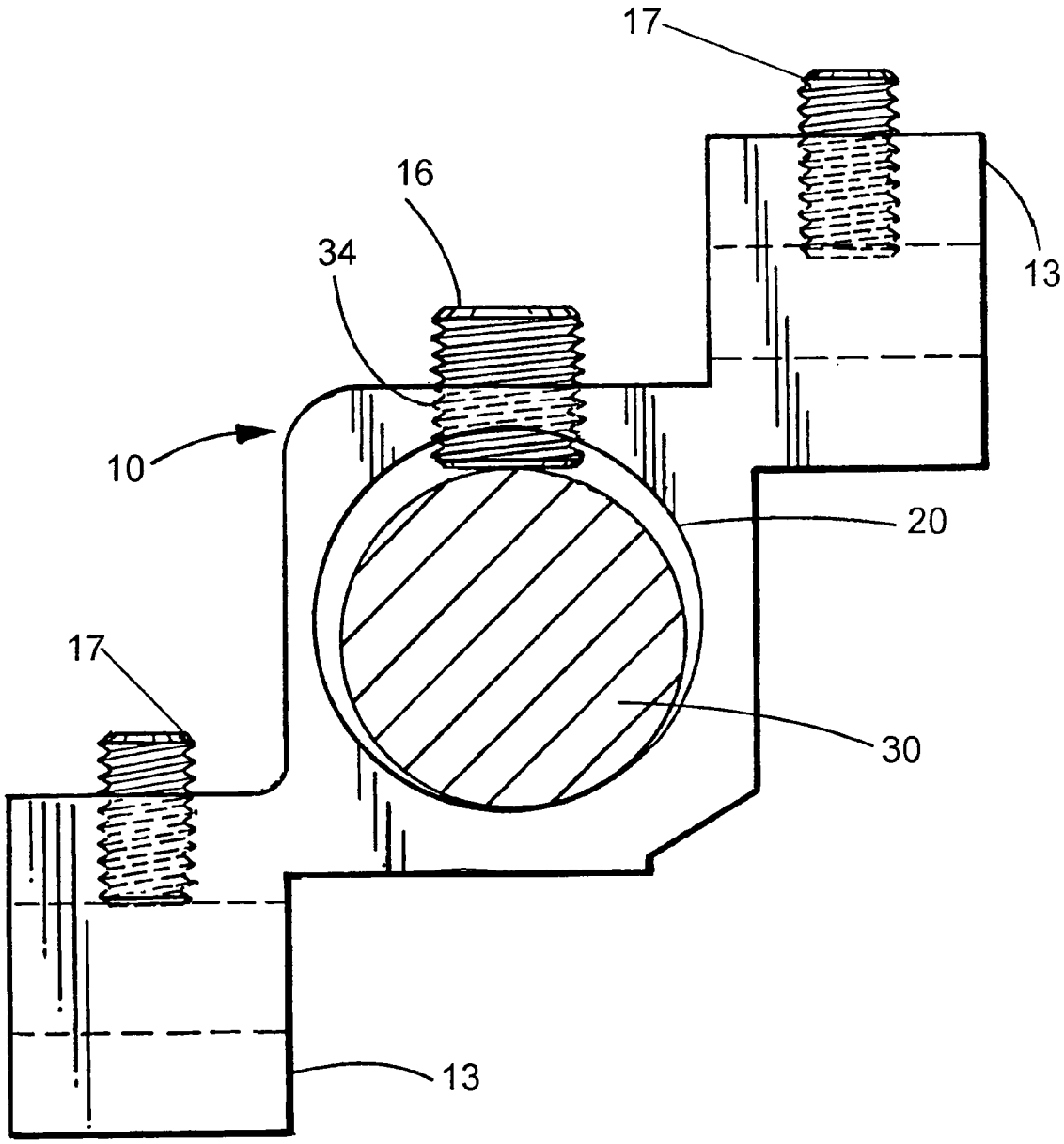
FIG. 3 is a cross-sectional drawing of a connector according to the present invention having a stud installed.

Turning now to FIG. 3, there is shown a transformer stud 30 installed within aperture 20, which has a diameter slightly smaller than aperture 20, such that the connector 10 can be slipped over stud 30 without the stud and connector threads becoming engaged. Once the stud is fully inserted within the connector, set screw 16 is rotated to bear against stud 30, thereby causing the threads on stud 30 to engage the complementary pitch threads 14 within aperture 20 and thus secure the connector 10 to the stud. It should be noted that while a standard flat tip set screw is depicted, to minimize thread distortion, a saddle typed stud clamping screw can be used. The saddle type screw utilizes a saddle piece featuring the same type of thread pattern to allow for normal fit over the stud thread, therefore avoiding any thread damage and providing a more positive mechanical and electrical connection.

Figure 4:
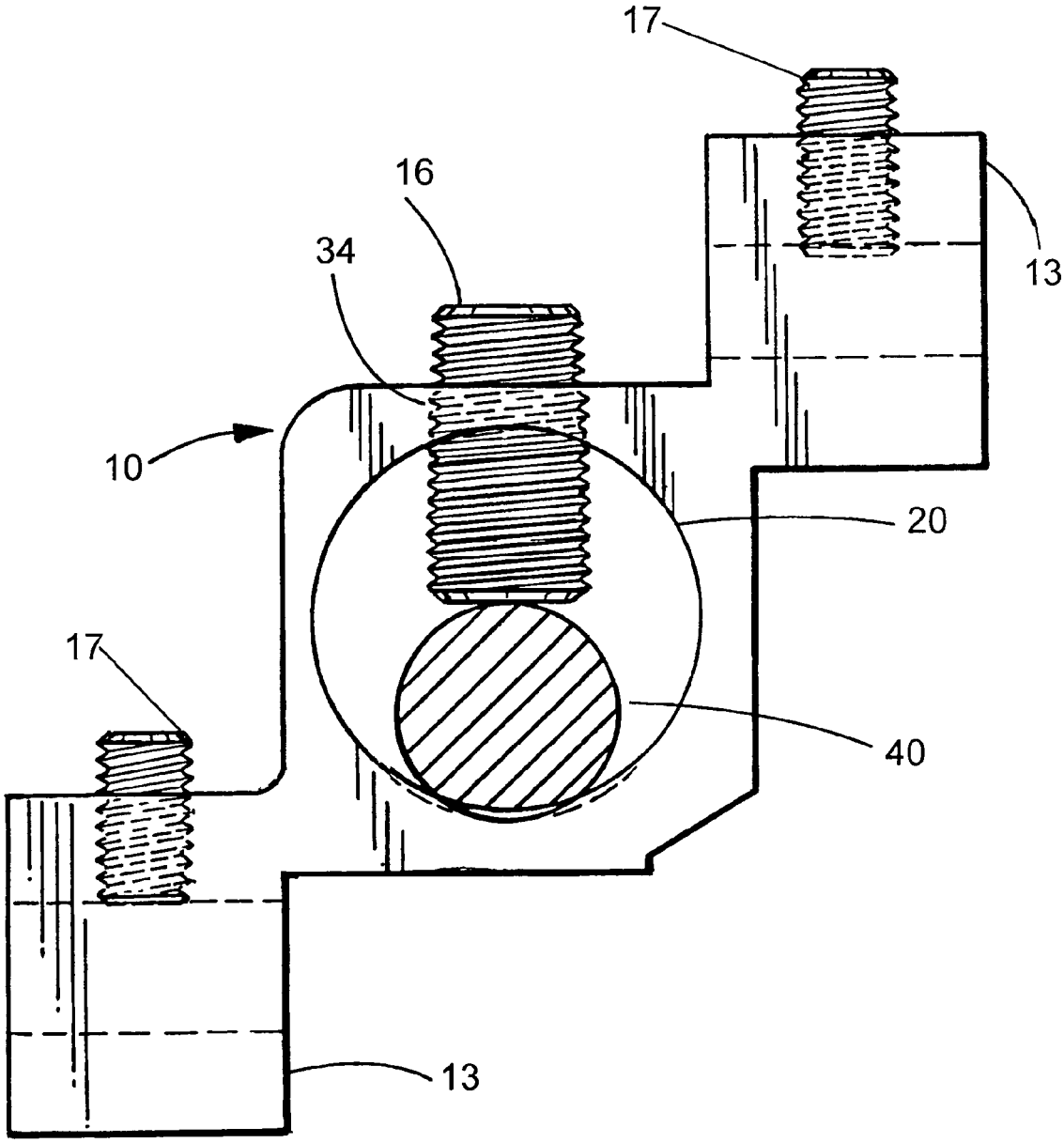
FIG. 4 is a cross-sectional drawing of a connector according to the present invention having an alternate stud installed.

Turning now to FIG. 4, there is shown a transformer stud 40 installed within aperture 20, which has a diameter smaller than aperture 20, such that the connector can be slipped over stud 40 without the stud and connector threads becoming engaged. Once the stud is fully inserted within the connector, set screw 16 is rotated to bear against stud 40, thereby causing the threads on stud 40 to engage the complementary pitch threads 14 within aperture 20 and thus secure the connector to the stud. Stud 40 engages the small diameter threaded region 24 of aperture 20 which are overlapped with the large diameter threads 22 that are engaged by stud 30 of FIG. 3 along the various tangent points 25 in thread cradle 27.

Figure 5:
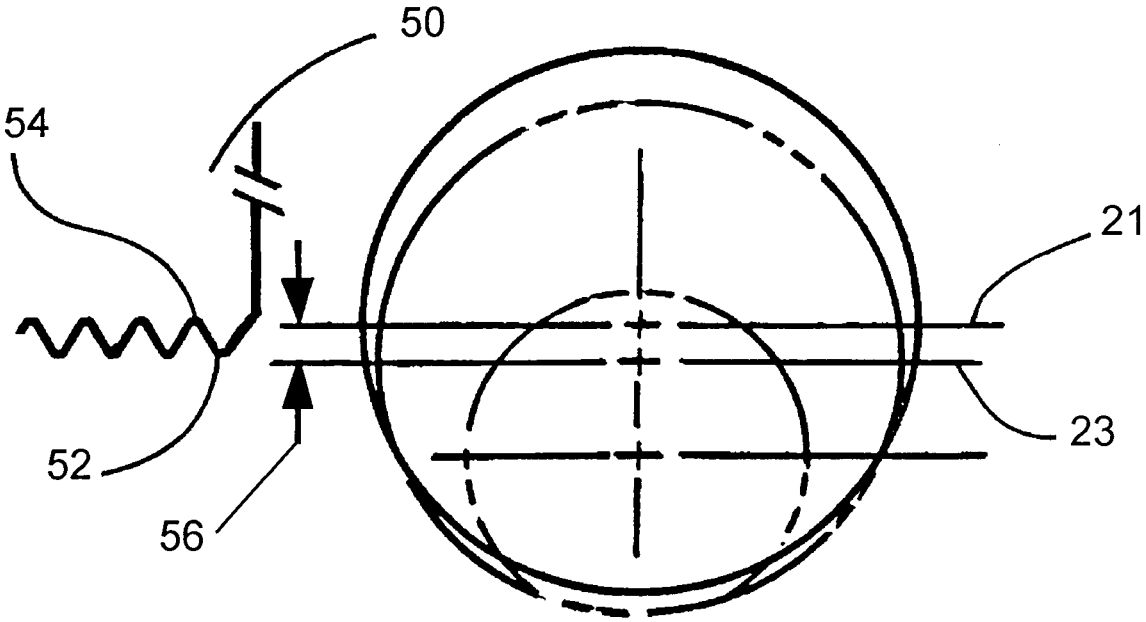
FIG. 5 is a schematic drawing of the threaded hole of the connector according to the present invention depicting the thread arrangement.

Turning now to FIG. 5, there is shown a side view of an exemplary stud thread 50 shown depicting the thread pitch of a one inch diameter stud. In the view depicted the stud thread crest 52 and valley 54 are shown. The crest 52 and valley 54 are separated by a root distance 56 that corresponds to the offset distance between aperture center 21 and large diameter thread center 23. It should be recognized by one skilled in the art that the stud 50, root distance 56 and offset distance 26 can be varied to suit a particular stud size. However, regardless of the size of the root distance 56, the offset 26 and root distance 56 are preferably equal, for a connector designed for a particular stud size.

Various changes to the foregoing described and shown structures would now be evident to those skilled in the art. Accordingly, the particularly disclosed scope of the invention is set forth in the following claims.

What is claimed is:

1. An electrically conductive transformer stud connector comprising:

a body with an elongated substantially circular passageway, for receiving at least a first and second transformer stud, each having a diameter and threads, the diameter of the first transformer stud being larger than the diameter of the second transformer stud; wherein said elongated passageway is in communication with at least one set screw port which is aligned orthogonally with said elongated passageway and having a set screw threadedly received therein for exerting a clamping force upon said transformer stud;

a first thread substantially corresponding to said first transformer stud threads to cooperatively mate therewith, wherein said first thread is formed in an arc in an inner circumference along a base portion of the elongated passageway;

a second thread substantially corresponding to second transformer stud threads to cooperatively mate therewith and positioned within to said inner circumference of the elongated passageway; wherein said second thread is formed within the arc of said first thread such that the first and second threads overlap at a point tangent to the base of the substantially circular passageway along a longitudinal axis of the set screw, the first and second thread sized to receive said first and second transformer studs therein.

2. An electrically conductive transformer stud connector of claim 1, further comprising a plurality of conductor ports for receiving a conductor spaced from and aligned perpendicularly to said elongated passageway along said body, each conductor port being in communication with a set screw port wherein said set screw port is aligned orthogonally with said conductor port and having a set screw threadedly received therein for exerting a clamping force upon said conductor.

3. An electrically conductive transformer stud connector of claim 1, wherein the majority of the inner circumference of said elongated passageway does not include threads and is substantially smooth.

4. An electrically conductive transformer stud connector of claim 1, wherein the arc of the first thread spans up to about 130 degrees or less of the elongated passageway inner circumference.

5. An electrically conductive transformer stud connector of claim 1, wherein said elongated passageway is in communication with a plurality of set screw ports.

6. An electrically conductive transformer stud connector of claim 1, having no threads around at least 230 degrees of the inner circumference of said elongated passageway.

7. A method of making an electrically conductive transformer stud connector comprising:

forming a cylindrical elongated passageway within a connector body by making a single bore within the connector, said passageway including an inner circumference and a substantially circular stud receiving end to received a threaded transformer stud therein;

forming at least one set screw port which is aligned orthogonally with said elongated passageway and having a set screw threadedly received therein for exerting a clamping force upon said transformer stud;

forming a first threaded region corresponding to a first predetermined thread size within an arc formed in the inner circumference along a base portion of the cylindrical elongated passageway;

forming a second threaded region within the arc of the first threaded region thereby overlapping said first threaded region at a point tangent to the base of the elongated passageway along a longitudinal axis of the set screw, the second threaded region corresponding to a second predetermined thread size smaller than the first predetermined thread size, said first and second threaded region receiving a stud having a thread size of substantially similar to either said first or second predetermined thread size for cooperatively mating therewith.

8. A method of making an electrically conductive transformer stud connector according to claim 7 wherein the arc of the first threaded region spans up to about 130 degrees or less.

9. A method of making an electrically conductive transformer stud connector according to claim 7 wherein forming said first threaded region is formed by a tapping or milling operation.

10. A method of making an electrically conductive transformer stud connector according to claim 7 wherein forming said second threaded region is done by a milling operation.

* * * * *